United States Patent [19]

Sting et al.

[11] Patent Number: 4,986,582

[45] Date of Patent: Jan. 22, 1991

[54] CLOSURE CONNECTING ROD MECHANISM

[75] Inventors: Benno Sting, Netphen; Gerhard Hartmann, Wilgersdorf, both of Fed. Rep. of Germany

[73] Assignee: Siegenia-Frank KG, Siegen, Fed. Rep. of Germany

[21] Appl. No.: 420,295

[22] Filed: Oct. 12, 1989

[30] Foreign Application Priority Data

Oct. 21, 1988 [DE] Fed. Rep. of Germany .... 3835835.2

[51] Int. Cl.[5] ..... E05C 9/02

[52] U.S. Cl. ..... 292/336.3; 292/39; 292/DIG. 51; 49/395

[58] Field of Search ..... 292/39, 336.3, 142, 292/DIG. 51, 160, 172; 49/395, 449

[56] References Cited

U.S. PATENT DOCUMENTS 1,968,285 7/1934 Egan ..... 292/39 X 4,848,811 7/1989 Laufenburg et al. ..... 292/39 X

FOREIGN PATENT DOCUMENTS 2334780 1/1975 Fed. Rep. of Germany ... 292/DIG. 51

*Primary Examiner*—Richard E. Moore

*Attorney, Agent, or Firm*—Gerry A. Blodgett; Norman S. Blodgett

[57] ABSTRACT

On a panel frame 1 of a closure made of metal or plastic profiles, the grooved surface 4 has a guide channel 5 which is open on one side, but provided on both sides with undercuttings 6 in the crosswise direction for the accommodation of a connecting rod. The connecting rod found in guide channel 5 is coupled by the open side of the latter with a control mechanism, which has a pinion 14 that can be driven by an operating handle and is supported in a housing. In the region of incorporation of the control mechanism, the metal or plastic profile of panel frame 1 is provided with a notch 22, which penetrates the bottom 8 of guide channel 5 and in which is engaged the housing segment 15 of the control mechanism supporting pinion 14. At least one of the ends of a coupling slide bar 17 of longitudinally displaceable guiding housing segment 16 of the control mechanism permanently engaged with pinion 14 is supported in front of the open side of guide channel 5 on the metal or plastic profile. A rotating latch 24 is supported in the housing with axis parallel to the principal plane of pinion 14, and has projecting pieces or tabs **30*a* or 30*b*, the upper side of which is distanced from the rearward extending longitudinal edges of housing segment 16. In a first rotational position of rotating latch 24, the projecting pieces or tabs 30*a* or 30*b* are taken up flush by a recess 31*a*, 31*b* in housing segment 15 supporting pinion 14, while they are swung out in a second rotational position, projecting over the lateral surfaces of the housing segment 15, into the undercut region 6 of guide channel 5**.

7 Claims, 1 Drawing Sheet

CLOSURE CONNECTING ROD MECHANISM

BACKGROUND OF THE INVENTION

The invention concerns a window, a door or the like closure, in which at least the panel frame is comprised of metal or plastic profiles. The closure has on its grooved surface or rabbet plane a guide channel open on one side, but has undercut profiles on both sides in the cross-sectional direction for the uptake of a connecting rod which is longitudinally displaceable. The connecting rod found in the guide channel may thus be coupled to a control mechanism adjacent to the open side of the channel, which [mechanism] has a drive member, e.g., a pinion, which is supported in a housing and which can be rotated by an operating handle. Further, the housing of the control mechanism is supported on the metal or plastic profile in front of the open side of the guide channel and can be attached to the latter, for example, by screw fittings. In addition, the operating handle is engaged in form-locking manner with a polygonal pin, for example, a square or hexagonal pin, from the room-side front surface of the panel frame out through a hole in the metal or plastic profile, into a correspondingly profiled engagement recess of the drive member and is held with the latter by means of a screw coupling.

A window, a door, or like closure of this type is shown in EP-A 0 283,659. Here only one mounting space is necessary for the control mechanism of the connecting rod mounting in front of the grooved surface or rabbet plane of the panel frame displaying the undercut profiled guide channel, since it is available in the conventional profile configuration with a dimension of approximatelY 10 mm without anything further. According to this state of the art, at least the metal or plastic profile of the panel frame is provided with a through-hole in the mounting region of the control mechanism. The hole penetrates the bottom of the guide channel in the metal or plastic profile, through which is passed the housing segment of the control mechanism supporting the drive member or pinion. Therefore, only that housing section of the control mechanism (which receives or guides in a longitudinally displaceable manner the ends of a coupling slide bar which is permanently engaged with the drive member or pinion) extends in front of the open side of the guide channel on the metal or plastic profile.

Thus a durable, problem-free function of the connecting rod mounting is assured, if, as in EP-A 0 283,659, the length of the coupling slide bar has dimensions such that at least through its maximal adjustment path, it is longer than the length of the through-hole in the bottom of the guide channel on the metal or plastic profile. The coupling slide bar is provided on both ends with engaging pieces projecting backward from a slot opening in the housing section of the control mechanism guiding it. These engaging pieces may be engaged in the proper engagement recesses in the connecting rod. In addition to this, the housing section of the control mechanism supporting the drive member or pinion is provided with an engagement thread for fastening screws at least on one side, but preferably on both sides, in a plane passing through the rotational axis of the drive member or pinion and parallel to the direction of motion of the coupling slide bar. The thread also engages a round anchor plate for the operating handle supported on the room-side front surface of the panel frame.

As shown in EP-A-0 283,659, it is also known in the prior art how to join insert nuts such as so-called "riveting nuts" for engaging the fastening screws for the round anchor plate of the operating handle directly with the panel frame and to attach the housing of the control mechanism in this functional position, secure against tilting and displacement, by means of overlapping and underlapping spacers as well as a locking screw against an undercut region of the guide channel.

According to the state of the art corresponding to EP-A 0 283,659, however, there are certain inadequacies of the groove technique, if the undercut profiled guide channel of the metal or plastic profile and the housing of the control mechanism for the connecting rod mounting are not precisely conformed with each other with respect to mounting criteria.

Apart from the fact that the mounting of the control mechanism in the panel frame profile is made difficult, it can also happen that the seat of the latter on the panel frame will become loose after a relatively short time of practical use. The operation of the connecting rod mounting is at least made difficult by this.

The primary objects of the invention are to create a window, a door, or the like with a connecting rod mounting of the generic type, in which the groove or mounting of the control mechanism for the connecting rod mounting onto the panel frame is simplified and, in addition, in which the orderly seating of the control mechanism on the panel may be assured permanently during practical use, even when the mounting dimensions on the metal or plastic profile and on the housing of the control mechanism are not precisely conformed.

With these and other objects in view, as will be apparent to those skilled in the art, the invention resides in the combination of part set forthin in the specification and covered by the claims appended hereto.

SUMMARY OF THE INVENTION

These objects are obtained according to the invention basically by the fact that in the housing segment receiving the ends of the coupling slide bar, at least one rotating latch is supported with axis parallel to the principal plane of the drive member, that the rotating latch has on one side a tool engagement accessible through the front wall of the housing segment and on the other side has a projecting piece or tab, whose upper side is distanced from the backward longitudinal edges of the housing segment, and that the projecting piece or tab is taken up flush in a rotating position of the rotating latch by a recess in the housing segment supporting the pinion. This tab can pivot in its other rotational position, projecting over the side surfaces of this housing segment, into the undercut region of the guide channel on the metal or plastic profile of the panel frame.

It is possible by means of this configuration according the invention to set the control mechanism of the connecting rod mounting in the region of the through-hole in a direction parallel to the panel plane in the metal or plastic profile and to assure its attachment position simply by displacing the rotating latch from its resting position to the attachment position.

Thus if the surfaces entering into an effective joint with the undercut regions of the guide channel on the metal or plastic profile have a wedge-shaped ascending position with respect to the rotational plane of the rotating latch and in the direction of rotation, a braced attachment of the control mechanism on the metal or plastic profile can be conducted solely by means of the rotating latch.

According to another feature of the invention the rotating latch lies with its rotational axis on the longitudinal central plane in the housing of the control mechanism and, on diametrically opposite peripheral surfaces, bears two arms extending in axis-parallel manner from its back side, each of which is provided on its free end with a projecting piece or tab, which runs approximately tangentially to the periphery of the rotating latch.

In this way, a symmetrical attachment with respect to the longitudinal central plane of the housing of the control mechanism on the metal or plastic profile can be conducted by acting on the rotating latch.

According to another characteristic of the invention the rotating latch has an annularly bounded disk, which is held within the housing segment taking up the ends of the coupling slide bar between the its front wall and the gearing segment of the coupling slide bar, whereby the arms bearing the projecting pieces or tabs of the rotating latch are guided laterally on the longitudinal edges of the coupling slide bar.

A stable configuration and reliable support of the rotating latch can be obtained by these measures.

A further characteristic of the invention lies in the fact that the housing segment containing the coupling slide bar bears laterally projecting flanges, in which screw threads are provided that are aligned at least approximately crosswise to the rotational plane of the rotating latch, in which threads are provided as locking screws, which can be braced against the outer front surfaces of the undercut profiled guide channel.

Thus it is of particular advantage if, according to the invention, the free ends of the projecting pieces or tabs in their active position lie approximately opposite the locking screws within the undercut profiled guide channel.

A further feature of the invention, provides that the angle of rotation of the rotating latch is limited to approximately 45°.

The invention also provides that guide holes are formed for fastening screws on both sides of the drive member and parallel to the axis of the latter in the housing segment of the control mechanism containing the drive member, by means of which the round anchor plate of the operating handle can be attached to the metal or plastic profile of the panel frame. If these guide holes are closely adapted to the nominal size of the attachment screws, the effective joint between the operating handle and the control mechanism may be optimized by engaging the fastening screws in these guide holes.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
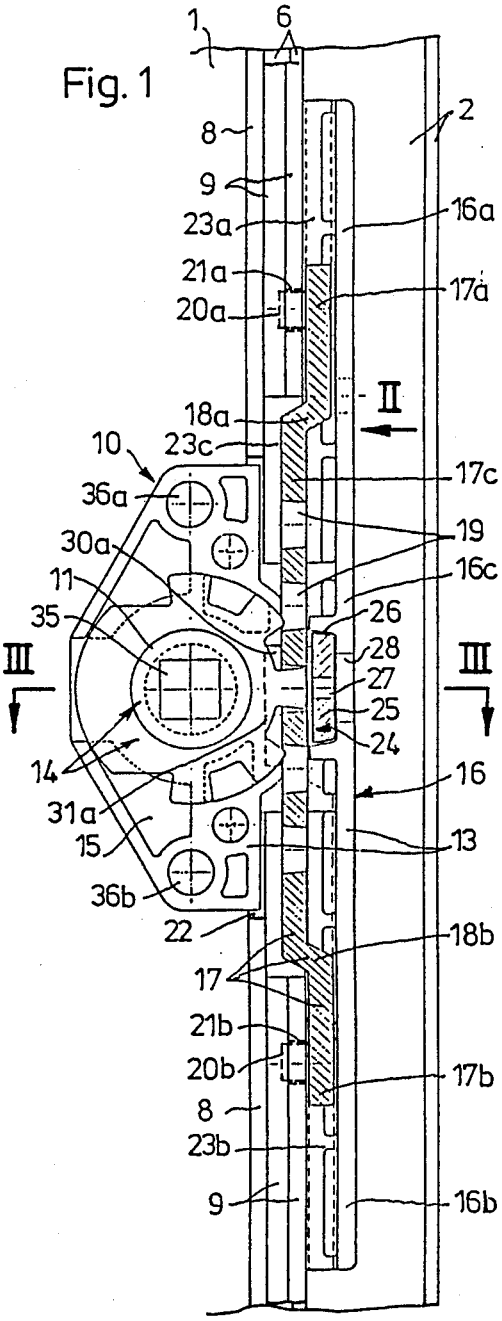
FIG. 1 shows a broken away longitudinal section of the panel frame of a window, a door, or the like with the control set therein on an enlarged scale.

A cutaway region of one panel frame 1 from a window, a door or the like (which conventionally consists of a stationary frame and a panel frame) may be seen in the drawing. This panel frame 1 is comprised of metal or plastic profiles, which are manufactured by extrusion. Preferably light metal profiles are used for the manufacture of panel frame 1. The frame has a projecting piece 2 aligned parallel to the panel plane, on which is attached a grooved section 3—essentially at a right angle. This grooved section is thus formed by a profile wall on the outside of which, the so-called grooved surface or rabbet plane 4, a guide channel is provided open on one side, but undercut on both sides in cross-section. This guide channel 5 is thus bounded on both sides by a hook-shaped piece 6 with, for example, an L or angle profile, configured such that the two hook pieces 6 are turned toward each other with their free hook sides. Together these define an open longitudinal gap 7 in the guide channel, as can be seen particularly clearly in FIGS. 2 and 3.

Guide channel 5 is bounded on the inside by a bottom 8, which forms a part of grooved section 3 of panel frame 1. Connecting rods 9 can be inserted in longitudinal direction on panel frame 1 in this guide channel 5, as can be seen in FIG. 1.

A control mechanism 10, whose structure can be essentially derived from the illustration in FIG. 1, is coordinated with panel frame 1. The connecting rod 9 is taken up in its guide channel 5 and can be moved in the longitudinal direction.

In addition, an operating handle with a round anchor plate, not shown in the drawing, but with known configuration is coordinated with panel frame 1 and control mechanism 10 incorporated in the latter.

Thus the round anchor plate of the operating handle is joined with panel frame 1 by screws, whereby these screws are effectively joined with so-called riveting nuts, which are inserted in rotation-proof manner at least in the room-side front wall of the metal or plastic profile. They are thus crossed over or covered by the round anchor plate of the operating handle.

Control mechanism 10 has a drive housing 13, which has a housing segment 14 supporting a rotatable drive member, for example, a pinion 14. It also has a housing segment 16 joined to it, in which a coupling slide bar 17 is guided in a longitudinally movable manner and permanently mated with pinion 14.

In the direction of motion of coupling slide bar 17, the housing segment 16 guiding the latter extends beyond the housing segment 15 supporting pinion 14 on opposite sides by a considerable extent, and thus forms on each side a bearing portion **16*a* or 16*b*, as can be clearly seen from FIG. 1**.

Thus end segment **17*a* of coupling slide bar 17 is guided in bearing portion 16*a*, and end section 17*b* is guided in bearing portion 16*b*, while the middle section 17*c* of the latter is shifted back up against the middle housing segment 16*c* toward housing segment 15, as is made clear in FIG. 1. For this purpose, end segments 17*a* and 17*b* are each connected by means of a shoulder piece 18*a* or 18*b* to the middle section 17*c*, which contains the engagement gearing 19 for pinion 14**.

Engagement pins or tangs **20*a* and 20*b* on the back side of end segments 17*a* and 17*b* of coupling slide bar 17 project backward from bearing portions 16*a* and 16*b*** of housing segment 16 and engage with coupling holes 21a or 21b of connecting rod 9. The holes are accommodated in undercut guide channel 5 on panel frame 1.

Figure 3:
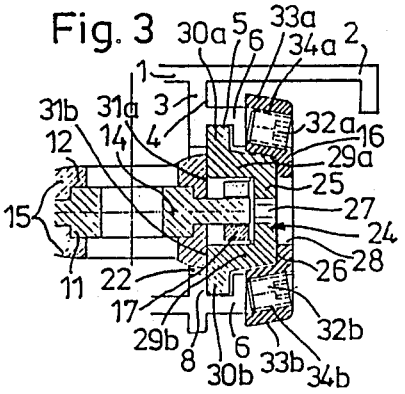
FIG. 3 shows a partial section along line III—III through the panel frame and the control mechanism according to FIG. 1.

On one side, housing segment 16 of drive housing 13 comes to rest with its back surface on the front surfaces of both hook pieces 6 which bound the guide channel 5 adjacent to the open longitudinal gap 7 (FIGS. 1 and 3). On the other side, the housing segment 15 supporting pinion 14 of the latter penetrates a notch 22, which is provided in the bottom 8 which forms the bottom boundary of guide channel 5. This can also be best seen in FIGS. 1 and 3.

Pinion 14 is supported in housing section 15 of drive housing 13 on both sides by means of a collar 11, which is held up on the inside of housing section 15 by bearing steps 12 adapted for this purpose.

In each case the lateral guidance of coupling slide bar 17 is effected in the region of end segments 17a and 17b in by guide surfaces 23a and 23b, which are formed laterally in housing segment 16. Similar guide surfaces 23c, which are present in the crossover region between housing segment 16 and housing segment 15 within drive housing 13 serve for lateral guidance of the slide bar middle section 17c, as can be seen in FIG. 2.

Figure 2:
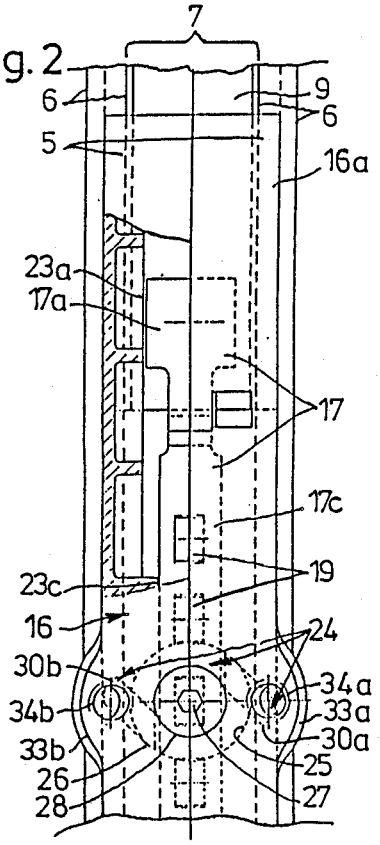
FIG. 2 shows a partial view of the panel frame and the control in the direction of arrow II of FIG. 1.

At least one rotating latch 24 is arranged in housing segment 16 of drive housing 13 taking up at least the end sections 17a and 17b of the coupling slide bar 17 beyond the region of movement of the middle section 17c of coupling slide bar 17 having the engagement gearing 19 for pinion 14, as can be seen in FIGS. 1–3 of the drawing.

This rotating latch 24 has an annular disk 25, which is held up on the inside of housing segment 16 by its peripheral surfaces that are adapted to a bearing depression 26. This bearing depression 26 is directly connected to the front wall of housing segment 16. Disk 25 of rotating latch 24 has a tool engagement 27—for example, a hexagon socket, which is accessible through an opening 28 in the front wall of housing segment 16.

Disk 25 of rotating latch 24 is held in the depression 26 with axis parallel to the principal plane of pinion 14 it in fact lies on the longitudinal central plane of housing 13 and has arms 29a and 29b in two diametrically opposed peripheral regions projecting in a parallel longitudinal manner on their back side. Each of these arms has in its turn a projecting piece or tab 30a or 30b, on the respective free end which is aligned approximately tangentially to the periphery of disk 25 of the rotating latch. This is best seen in FIG. 2.

Arms 29a and 29b of rotating latch 24 are arranged on the disk 25 and have in addition a cross section such that they pass laterally on central segment 17c of coupling slide bar 17 and make possible an angular rotation of rotating latch 24 in bearing depression 26 of approximately 45°.

In a first rotational position of rotating latch 24, the projecting pieces or tabs 30a or 30b thus have an alignment parallel to the longitudinal edges of the drive housing 13 and may be taken up on the outside flush with the surface by an indentation 31a or 31b in the side walls of the housing segment 15 supporting pinion 14. It is then possible that control mechanism 10 can be inserted through the open longitudinal gap 7 of guide channel 5 and the notch 22 in bottom 8 of the latter and panel frame 1, as can be seen in FIGS. 1 and 3.

Since projecting pieces or tabs 30a and 30b are connected to the free ends of arm 29a and 29b, they have a position that is back-displaced with respect to the rear surfaces of housing segment 16 and thus come to lie at the level of the undercut region of hook pieces 6 bounding guide channel 5, after the control mechanism 10 is inserted, as soon as the back surface of housing segment 16 reaches the outside of these hook pieces 6.

Now if rotating latch 24 is rotated from its first position by 45°, then the projecting pieces 30a and 30b reach the undercut region, and are engaged below hook pieces 6 of guide channel 5, as is illustrated in FIGS. 2 and 3. Rotating latch 24 effects in this way a positional attachment of control mechanism 10 on panel frame 1 and prevents it from popping out of notch 22 and guide channel 5.

In many cases it may be sufficient to utilize one rotating latch 24 alone for fixing drive housing 10 in panel 1. It would, however, also be conceivable to distribute several rotating latches 24 over the length of housing segment 16 on drive housing 13 for this purpose.

In any case, it may be preferable to configure the upper and/or lower sides of projecting pieces or tabs 30a and 30b (which spread from arms 29a and 29b tangentially to the periphery of disk 25) as wedged surfaces, thus establishing a locking effect for fixing control mechanism 10 by rotation in the undercut regions of hook pieces 6 bounding guide channel 5.

In the example of embodiment of a window, a door, or the like shown in the drawing, rotating latch 24, however, does not serve for the definitive fixing of control mechanism 10 on panel 1. Rather, with projecting pieces or tabs 30a and 30b sitting on the ends of its arms 29a and 29b, it provides simply abutments which can be swung in and out for holding drive housing 13 on panel 1. However, special locking screws 32a and 32b are utilized here for definitive or rigid bracing, which may be seen in FIG. 3. According to FIG. 2, the housing segment 16 guiding at least the end sections 17a and 17b of the coupling slide bar 17 has flanges 33a and 33b bounded in an arc-shaped manner and projecting laterally in the region of incorporation of rotating latch 24. In these flanges internally threaded holes 34a and 34b are provided aligned at least approximately crosswise, i.e., inclined to the rotational plane of rotating latch 24. Locking screws 32a and 32b are provided in these threaded holes.

These locking screws 32a and 32b thus preferably have tool engagements which correspond to the tool engagement 27 of rotating latch 24. They may thus be tightened and loosened with the same tool (hexagonal socket head), with which rotating latch 24 can also be brought in and out of engagement. Clamping screws 32a and 32b may be braced against the outer front surfaces of both hook pieces bounding the undercut profiled guide channel 5, after rotating latch 24 has been introduced in the effective position seen from FIGS. 2 and 3. In this way a permanently secure fastening of control mechanism 10 to the panel frame 1 is accomplished by the cooperation of locking screws 32a, 32b, and rotating latch 24.

A permanent, problem-free cooperation of the operating handle engaged in the square nut 35 of pinion 14 can be assured with control mechanism 10 by means of a square lug, although the round anchor plate of the control mechanism is attached only by its attachment screws in rivet nuts provided in a rotation-free manner on panel frame 1. The housing segment 15 of drive housing 13 supporting pinion 14 is preferably provided, on both sides of pinion 14, with guide holes 36a and 36b lying in axis-parallel manner to the pinion (FIG. 1).

These guide holes 36a and 36b are displaced from the axis of rotation of pinion 14 such that they correspond to the distance of the fastening holes in the round anchor plate of the operating handle from the square pin of the operating handle. With a sufficiently long dimensioning of the fastening screws for the anchor plate, these may then penetrate into guide holes 36a and 36b of drive housing 13. They can thus secure the positional alignment on opposite sides, as long as guide holes 36a and 36b are adapted to the nominal diameter of the fastening screws with in a narrow play allowance.

Clearly, minor changes may be made in the form and construction of the invention without departing from the material spirt of it. It is not, therefore, desired to confine the invention to the exact form herein shown and described, but it is desired to include all such as properly come within the scope claimed.

The invention having been thus described, what is claimed as new and desired to secure by Letters Patent is:

1. A closure connecting rod mechanism for windows, or doors, having panels in which at least the panel frame is comprised of metal or plastic profiles, each panel having, on a grooved surface, a guide channel open in one direction, but undercut in profile on its sides, the channel formed to accomodate a longitudinally displaceable connecting rod, coupled at the open side of the channel with a control mechanism, which has a drive member which can be driven in rotatable manner by means of an operating handle and which is supported in a housing; wherein, further, a housing for the control mechanism is supported on the profile adjacent the open side of the guide channel for attachment to the channel; wherein, further, the operating handle is engaged, by means of a polygonal shaft from a room-side surface of the panel frame through a hole in the profile, into a correspondingly-sectioned recess in the drive member; wherein, in addition, the profile of the panel frame is provided with an opening in the region of incorporation of the control mechanism, which opening penetrates the bottom of the guide channel in the profile, and whereby a first housing segment of the control mechanism supporting the drive member passes through the opening in the bottom of the guide channel, while a second housing section, guiding the ends of a longitudinally mobile coupling slider in a permanent engagement with the drive element, is supported against the profile surface adjacent the open side of the guide channel.

characterized by the fact the in said second housing segment, a rotating latch 24 is provided, supported in a bearing depression with an axis parallel to the principal plane of the drive member; that the rotating latch has on one side a tool engagement accessible through a front wall of said second housing segment while on the other side, it is provided with at least one projecting piece, the upper side of which is distanced from the rearward longitudinal edges of the second housing segment; whereby the projecting piece is encompassed, in a first rotating position of rotating latch, by a recess in the first housing segment, while when the latch is pivoted into a second rotational position, the projecting piece extends beyond the side surfaces of the first housing segment, into the undercut region of guide channel.

2. A mechanism as recited in claim 1, further characterized by the fact that the rotating latch has an axis of rotation on a longitudinal central plane of the housing of the control mechanism and supports two peripheral axis-parallel arms substantially diametrically opposite each other, each arm being provided on a free end with said projecting piece, which runs approximately tangentially to the periphery of the rotating latch.

3. A mechanism as recited in claim 2, further characterized by the fact that the rotating latch has an annular shaped disk, which is held within said second housing segment in a bearing depression whereby the arms bearing the projecting pieces of the rotating latch extend laterally to the longitudinal edges of coupling slide bar and to the recesses.

4. A mechanism as recited in claim 3, further characterized by the fact that the second housing segment is provided with laterally projecting flanges in which are provided threaded holes aligned approximately crosswise to the rotational plane of rotating latch, in which holes locking screws are provided adapted to be braced against the outer front surfaces of the undercut, profiled guide channel.

5. A mechanism as recited in claim 4, further characterized by the fact that the free ends of the projecting pieces lie approximately opposed to locking screws within the undercut profiled guide channel when the rotating latch is in said second rotational position.

6. A mechanism as recited in claim 5, further characterized by the fact that the rotating angle of rotating latch is limited to apporximately 45°.

7. A mechanism as recited in claim 6, further characterized by the fact that guide holes are formed for fastening screws on both sides of the drive member and axis-parallel to the latter in said first housing segment of control mechanism by means of which screws on anchor plate of an operating handle is adaptable to be attached to the metal or plastic profile of panel frame, and wherein the guide holes are closely adapted to the size of corresponding fastening screws.

* * * * *